United States Patent [19]

Stewart

[11] Patent Number: 4,785,652

[45] Date of Patent: Nov. 22, 1988

[54] INDIRECT EXTRUSION PRESS WITH RAM-MOUNTED TURRET SUPPORTING TOOLING

[76] Inventor: Charles L. Stewart, 1733 Addison Rd., Palos Verdes Estates, Calif. 90274

[21] Appl. No.: 887,059

[22] Filed: Jul. 18, 1986

[51] Int. Cl.[4] ..... B21C 23/20

[52] U.S. Cl. ..... 72/263; 72/273.5

[58] Field of Search ..... 72/263, 273.5

[56] References Cited

U.S. PATENT DOCUMENTS

| | | |
|---|---|---|
| 715,358 | 12/1902 | Dick . |
| 1,712,259 | 5/1929 | Davis . |
| 2,363,635 | 11/1944 | Blair . |
| 3,528,275 | 9/1970 | Sibler . |
| 3,738,144 | 6/1973 | Doudet . |
| 4,522,052 | 6/1985 | Doudet . |

FOREIGN PATENT DOCUMENTS

| | | | |
|---|---|---|---|
| 2613090 | 10/1976 | Fed. Rep. of Germany | 72/263 |
| 649983 | 12/1928 | France | 72/273.5 |
| 2089704 | 6/1982 | United Kingdom | 72/273.5 |

*Primary Examiner*—Lowell A. Larson

*Attorney, Agent, or Firm*—Spencer & Frank

[57] ABSTRACT

An indirect extrusion press and method of operating the press. The press includes a container with opposite axial ends and an axial cavity for receiving a billet. The container is mounted for aligning the axial cavity with the extrusion axis. A bolster is disposed adjacent one axial end of the container for blocking movement of a billet out of the cavity when a force is applied against the billet from the other axial end of the container. A ram is mounted on the side of the container adjacent the other axial end of the container for movement in the axial direction of the container. The ram has an axial passage therethrough aligned with the extrusion axis. A rotatable turret is mounted on the ram, and a hollow pressing stem is mounted on the turret. The turret is rotatable for placing the hollow pressing stem in a first position aligned with the extrusion axis, and in a second position off of the extrusion axis. When the hollow pressing stem is in the first position it communicates with the axial passage through the ram and can be moved axially, via the ram, to press a die through the cavity to extrude a billet to form an extrusion product which exits the container via the hollow pressing stem and the axial passage in the ram. When the hollow pressing stem is in the second position it permits other tooling to perform operations on the extrusion axis of the press.

15 Claims, 5 Drawing Sheets

INDIRECT EXTRUSION PRESS WITH RAM-MOUNTED TURRET SUPPORTING TOOLING

BACKGROUND OF THE INVENTION

The present invention concerns an arrangement for an indirect extrusion press for producing an extrusion product from a hot metal billet. More particularly, the present invention relates to an arrangement which finds particular utility in connection with an indirect extrusion press of the type described in applicant's copending U.S. application Ser. No. 836,629, filed on Mar. 5, 1986, the disclosure of which is incorporated herein by reference, wherein the press includes a plurality of containers arranged on a rotatable press turret. In such an arrangement the containers on the press turret are sequentially rotated through the extrusion axis of the press where extrusion actually takes place and through various working stations off of the extrusion axis where other functions are performed, such as removing an extrusion discard from a press container, cleaning a press container and loading a new billet into a press container.

The purpose of such a multiple container press is to maximize the efficiency of the press by minimizing the number of operations on the extrusion axis which are not involved in the actual extrusion of a billet. The foregoing application discloses a further time saving mechanization in connection with the changing of a container in the press turret. A relatively quick container changing procedure is desirable for overall press efficiency, for example when billets of different diameters are to be extruded, since the diameter of the cavity in the press container must match the diameter of the billet to be extruded, or when billets of a different metal are to be extruded, requiring a compatible replacement container.

The tooling of the press must also be changed to accommodate a billet of different diameter. It is a simple matter to load a die and pressure disc of appropriate diameter along with the billet into the press cavity. It is necessary, in addition, that the hollow pressing stem which pushes the die through the cavity of the container have an outer diameter corresponding to the diameter of the billet. Thus, in addition to changing the container to accommodate a billet of a different diameter than that previously extruded, it is also necessary to exchange the pressing stem with another pressing stem having the appropriate outer diameter. If the pressing stem is fixed to the ram, for example, by heavy duty bolts, this can be a time consuming process, resulting in significant downtime of the press. The present invention is therefore directed, in one aspect, to facilitating the changing of the pressing stem when it is desired to extrude a billet of a different diameter.

According to a further aspect of the invention, the configuration of the indirect extrusion press disclosed in copending application Ser. No. 06/836,629 makes it possible to utilize the main ram for the purpose of piercing the billets as well as pressing the billets to form an extrusion product. Although piercing the billets on the extrusion line does cut into the overall efficiency of the press in terms of decreasing the percentage of the press cycle time devoted to actual extrusion, the use of the main ram to pierce billets on the extrusion line according to this aspect of the invention, as will be described more fully below, offers an option which has the advantage of eliminating the requirement for a separate piercing machine, which is a costly piece of equipment. Additionally, by piercing the billets on the extrusion line, the billets do not require reheating as they would if pierced off of the extrusion line and subsequently transported to the press container for extrusion.

SUMMARY OF THE INVENTION

It is an object of the invention to provide an efficient manner of piercing billets on the extrusion line of an indirect extrusion press.

It is yet a more particular object of the invention to utilize the main ram of an indirect extrusion press for the purpose of piercing billets on the extrusion line of the press.

It is a further object of the invention to provide an indirect extrusion press which can extrude billets of different diameters and/or different metallic composition with great efficiency.

It is yet another object of the invention to provide an indirect extrusion press in which it is possible to quickly change the pressing stem of the press to provide a pressing stem of a different diameter when it is desired to extrude a billet of a correspondingly different diameter.

The above and other objects of the invention are accomplished according to the invention by the provision of an arrangement for an indirect extrusion press which includes:

a container with opposite axial ends and an axial cavity for receiving a billet, the container being mounted for aligning the axial cavity with the extrusion axis;

bolster means disposed adjacent one axial end of the container for blocking movement of a billet out of the cavity when a force is applied against the billet from the other axial end of the container;

a ram mounted on the side of the container adjacent the other axial end of the container for movement in the axial direction of the container, the ram having an axial passage therethrough aligned with the extrusion axis;

a rotatable turret mounted on the ram; and a hollow pressing stem mounted on the turret, the turret being rotatable for placing the hollow pressing stem in a first position aligned with the extrusion axis, and in a second position off of the extrusion axis, wherein when the hollow pressing seem is in the first position it communicates with the axial passage through the ram and can be moved axially, via the ram, to press a die through the cavity to extrude a billet disposed between the die and the blocking means to form an extrusion product which exits the container via the hollow pressing stem and the axial passage in the ram, and when the hollow pressing stem is in the second position it permits other tooling to perform operations on the extrusion axis of the press.

According to one embodiment of the invention, a second hollow pressing stem having a diameter different from that of the first hollow pressing stem is mounted on the turret. The turret is thus rotatable for selectively placing one or the other of the pressing stems on the extrusion axis of the press in dependence of the diameter of the billet which is to be extruded during any given press cycle.

According to a further embodiment of the invention a piercing stem is mounted on the turret and the turret is rotatable for selectively placing one or the other of the pressing stem and the piercing stem on the extrusion line of the press. With this arrangement, it is possible to utilize the piercing stem to first pierce a billet disposed in a press container and then, by rotating the ram-mounted turret, placing the hollow pressing stem on the extrusion axis for extruding the pierced billet by a subsequent stroke of the main ram.

The invention also contemplates methods for operating indirect extrusion press arrangements of the foregoing type as will be described in greater detail below.

DESCRIPTION OF THE PREFERRED EMBODIMENTS OF THE INVENTION

Figure 1:
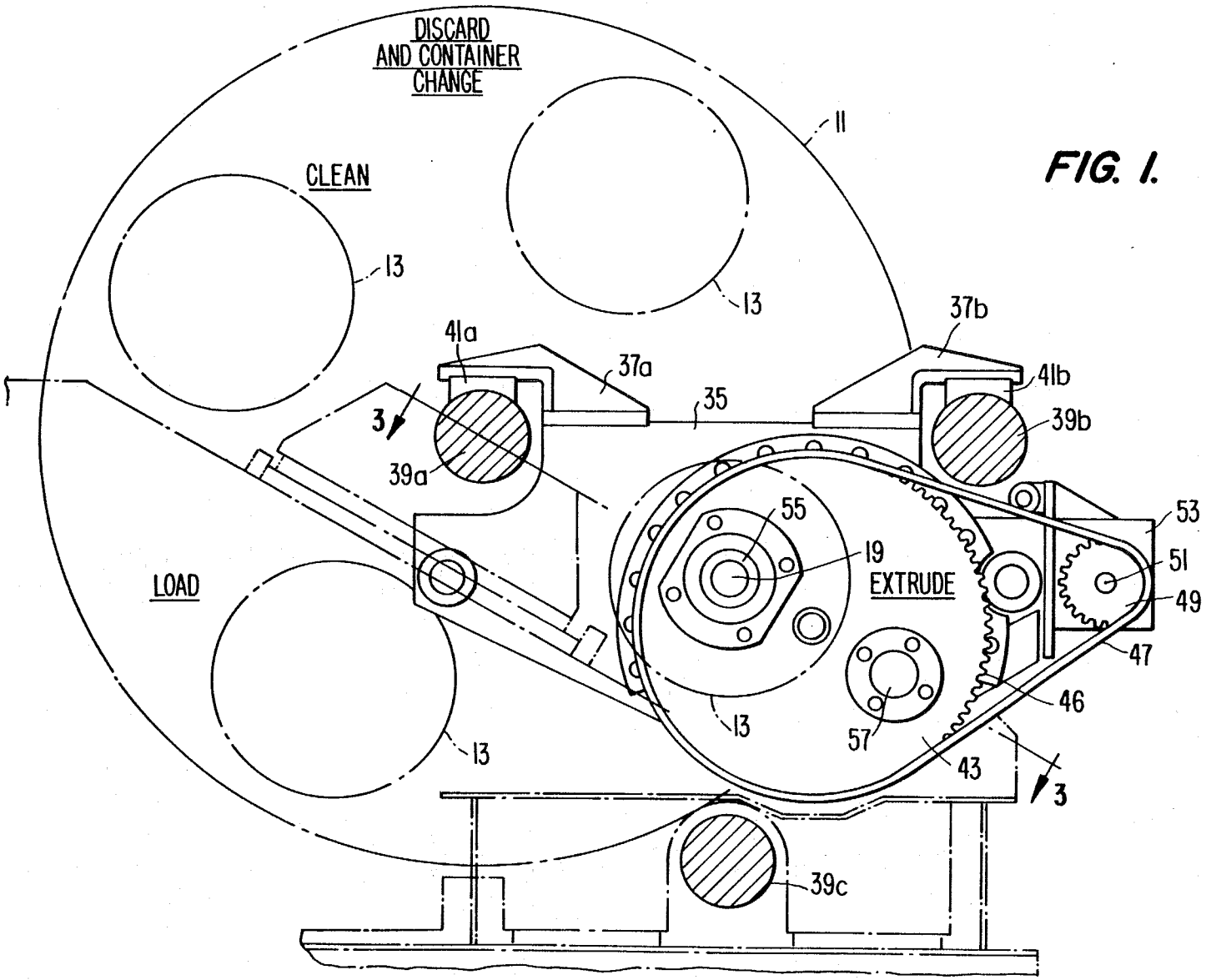
FIG. 1 illustrates an end view of a turret mounted on a main ram of an indirect extrusion press in accordance with the principles of the invention, and shows a multiple container press turret in phantom lines.
Figure 2:
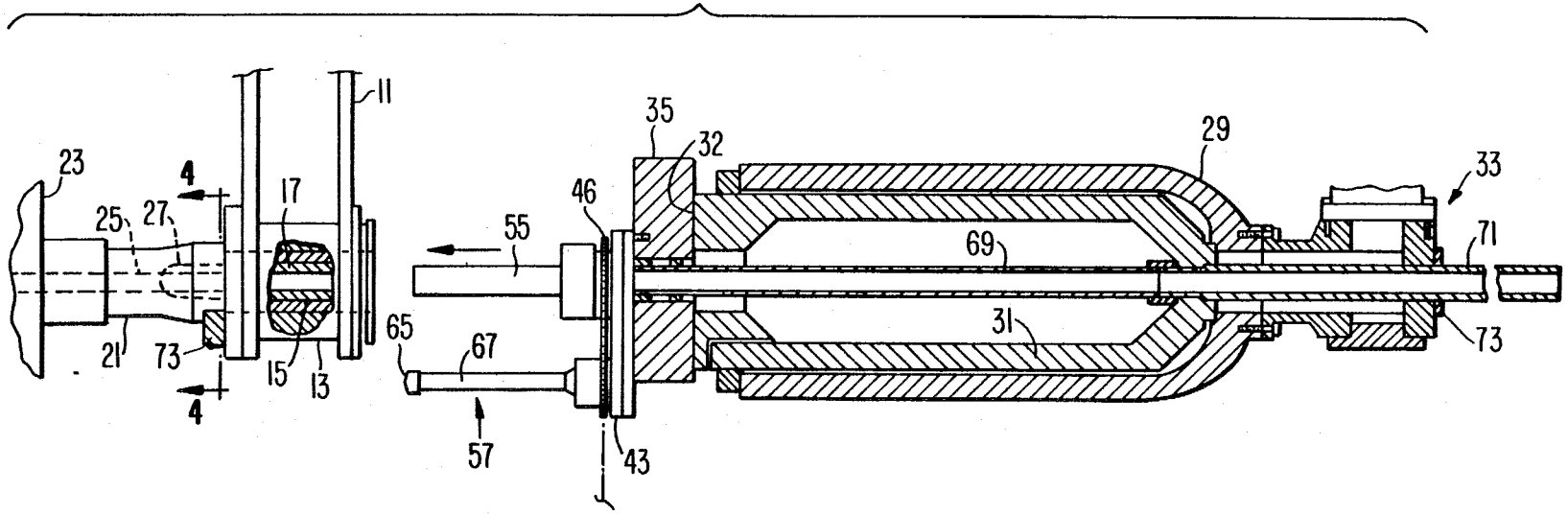
FIG. 2 is a longitudinal view in partial cross section of an indirect extrusion press with a ram-mounted turret according to one embodiment of the invention.

Referring to FIGS. 1 and 2, there is shown an indirect extrusion press according to one embodiment of the invention including a press turret 11 mounting a plurality of press containers 13. In FIG. 1 the press turret and containers are shown by phantom lines in that they are located above the plane of the paper. Referring more particularly to FIG. 2, container 13 includes a container liner 15 which defines a cavity in which a billet 17 is disposed. Press turret 11 is rotatable for placing containers 13, in seriatim, on the extrusion axis 19 of the press and in various stations off of the extrusion axis, including a discard and container changing station, cleaning station, and loading station as shown by the labels in FIG. 1. In FIG. 2 the container 13 is shown located o the extrusion axis with a bolster 21 located between the container 13 and a press platen 23. Bolster 21 in cooperation with a pressure disc (not shown) as disclosed in copending application Ser. No. 836,629 prevents the billet 17 from being pushed out the adjacent end of the container when a force is applied from the other end of the container during, for example, extrusion of the billet. Bolster 21 has a first axial passage 25 which may be aligned with the extrusion axis of the press for accommodating an extrusion mandrel which can be inserted through platen 23, bolster 21 and billet 17 for cooperating with a die (not shown) for extruding a hollow extrusion product. Bolster 21 may be provided with a further axial passage 27 which can also be aligned with the extrusion axis of the press for receiving a plug pushed out of billet 17 during a piercing operation as will be more fully described below.

The indirect extrusion press includes a main cylinder 29 enclosing a main ram 31 and being connected with a valve 33 through which hydraulic fluid can flow for pushing and retracting ram 31 out of and into, respectively, cylinder 29. Ram 31 has a face 32 exterior of cylinder 29 to which a cross head 35 is fixed. Cross head 35 has two arms 37*a* and 37*b* each of which straddle from the top a respective press tie rod 39*a* and 39*b*. A third press tie rod is shown at 39*c*. Arms 37*a* and 37*b* are provided with respective bearing elements 41*a* and 41*b* which slidingly ride along press tie rods 39*a* and 39*b*, respectively, for guiding cross head 35 as ram 31 is pushed out of and retracted into cylinder 29.

Figure 3:
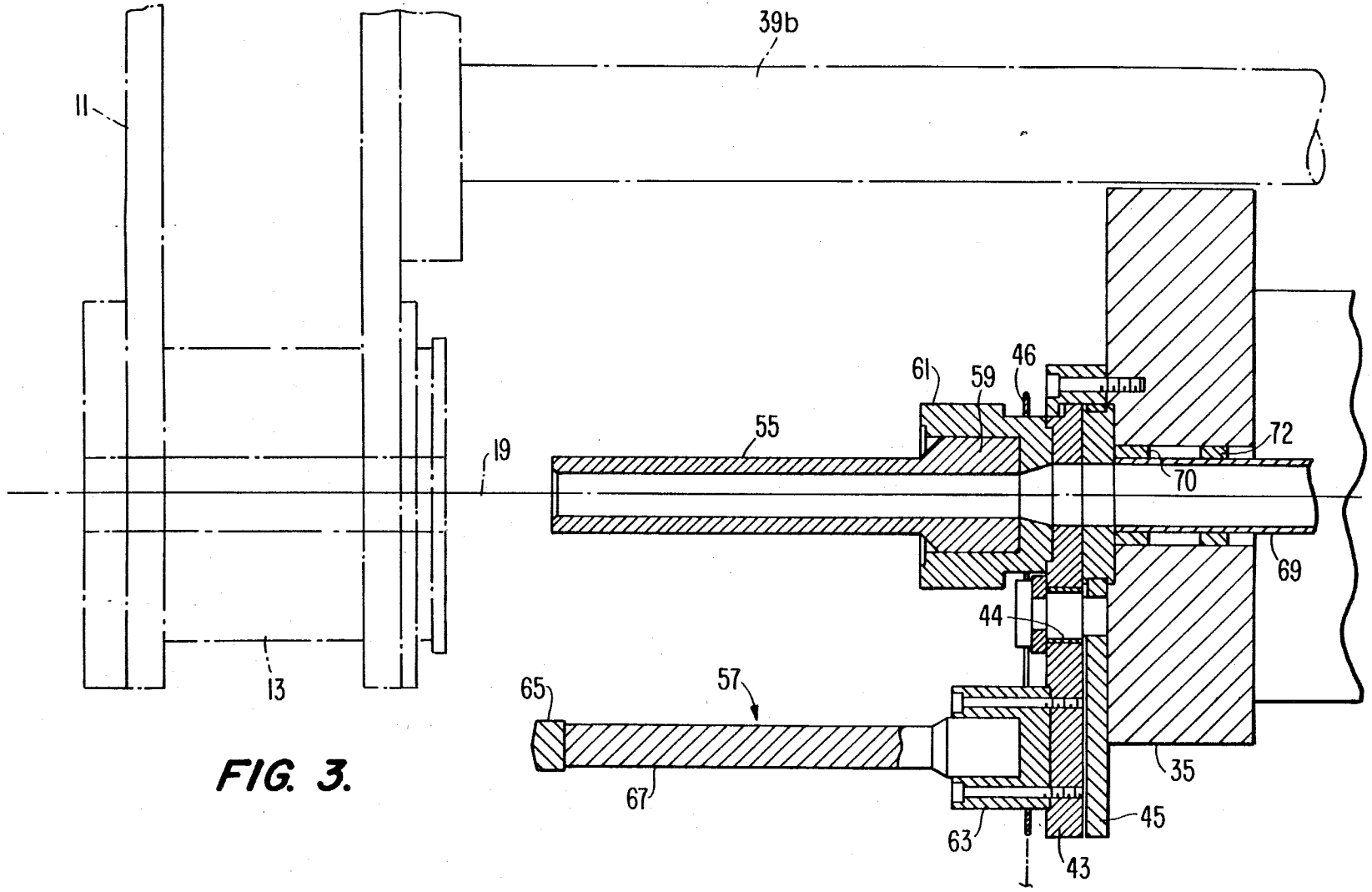
FIG. 3 is a cross sectional view along line 3—3 in FIG. 1.

Referring also to FIG. 3, a rotatable turret 43 is attached to cross head 35 via a hub 44 and an intermediate plate 45. Turret 43 is provided with a sprocket 46 which engages a drive chain 47. Chain 47 also engages a gear 49 which is connected via a shaft 51 to a controllable motor 53 for selectively rotoring turret 43.

According to one aspect of the invention turret 43 mounts both a hollow pressing stem 55 and a piercing stem 57. Referring specifically to FIG. 3 it can be seen that hollow pressing stem 55 has an enlarged end 59 which is retained by a socket 61 secured by suitable means, such as bolts (not shown), to turret 43. Similarly, piercing stem 57 is secured via a socket 63 to turret 43. Piercing stem 57 is provided with a tip 65 which has a diameter corresponding to the desired diameter of the hole to be pierced in a billet. The remaining portion 67 of the piercing stem has a slightly smaller diameter than tip 65 in order to reduce friction between piercing stem 57 and a billet during a piercing cycle.

Referring to FIGS. 2 and 3, ram 31 has a conduit 69 passing therethrough and centered on the extrusion axis of the press. Conduit 69 communicates through an opening provided in plate 45, turret 43 and socket 61 with the interior of hollow pressing stem 55 when the pressing stem is aligned with the extrusion axis. Conduit 69 serves as an exit passage through the ram for an extrusion product which is produced when pressing stem 55 is extended through container 13 during an extrusion cycle. Conduit 69 is fixed to cross head 35, for example by friction tight rings 70 and 72 and moves with ram 31 and cross head 35. Conduit 69 communicates with a further conduit 71 connected at the exit end (at the right-hand side in figure 2) of ram 31. Conduit 71 has a thicker wall than conduit 69 and is better able t withstand the pressures of the hydraulic fluid transported through valve 33. Conduit 71 is slidingly sealed by a seal 73 to prevent the escape of hydraulic fluid from valve 33 during movement of the ram.

Figure 4:
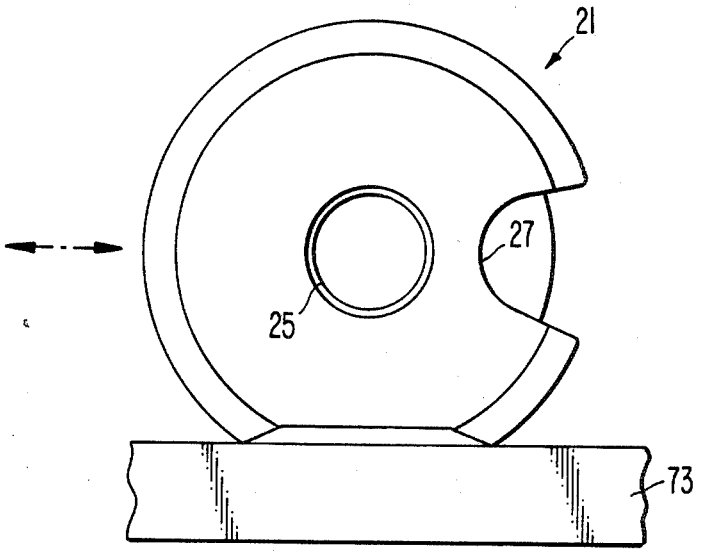
FIG. 4 is a cross sectional view along line 4—4 in FIG. 2.
Figure 5:
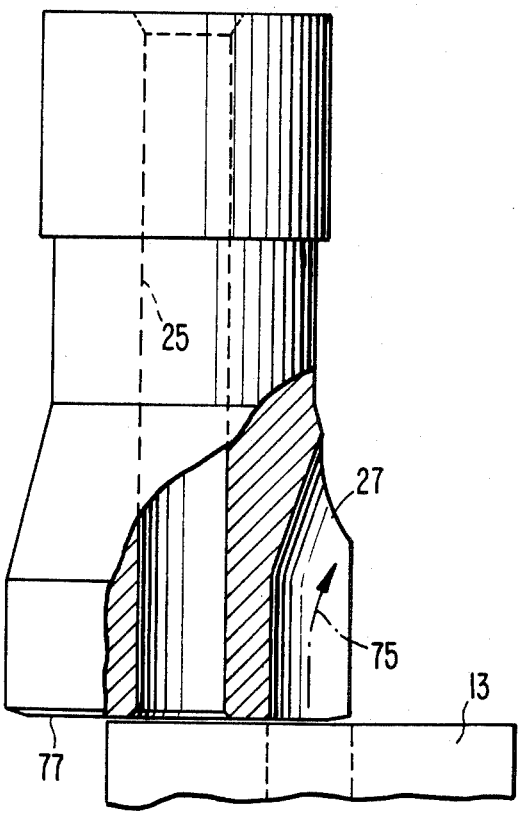
FIG. 5 is a longitudinal view in partial cross section of the bolster shown in FIG. 4.
Figure 6:
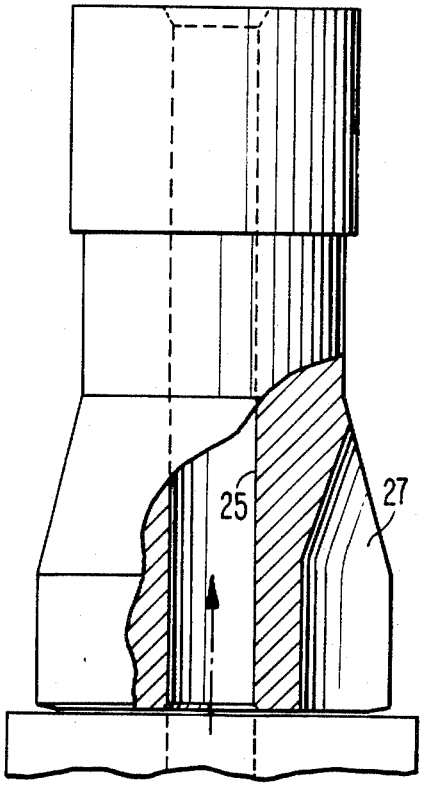
FIG. 6 is a similar view as shown in FIG. 5, with the bolster shifted transversely of the extrusion axis to another operational position relative to that shown in FIG. 5.

FIGS. 4 to 6 illustrate bolster 21 in greater detail. Bolster 21 is slidable along a bearing surface 73 by means, not shown, for moving the bolster transversely of the extrusion axis to place one or the other of the axial passages 25 and 27 in alignment with the extrusion axis. Bolster 21 is shown as being generally cylindrical in shape, with axial passage 25 being centrally located and passing clear through from one end face to the other. On the other hand, axial passage 27 is radially offset from passage 25 and has a radial opening at the circumference of the bolster. Passage 27 has a slight downward inclination at its end portion remote from container 13 for utilizing the force of gravity to eject a plug pushed out of a billet during a piercing operation.

FIG. 5 shows a plan view of bolster 21 positioned with axial passage 27 aligned with the extrusion axis of the press. Arrow 75 illustrates the path of a plug that will be pushed out of a billet during piercing. FIG. 6 illustrates the position of the bolster during an extrusion cycle wherein axial passage 25 is aligned with the extrusion axis so that an extrusion mandrel may be slid through the bolster and billet for cooperating with an extrusion die to produce a tubular extrusion product as will be understood by those skilled in the art.

The indirect extrusion press illustrated in FIGS. 1 to 6 operates as follows. An extrusion package comprised of a heated billet sandwiched between an extrusion die and a pressure disc is loaded into a container at the load position shown in FIG. 1. Loading apparatus for accomplishing this is disclosed in applicant's copending application Ser. No. 06/836,629. Press turret 11 is then indexed to place the loaded container on extrusion axis 19. Bolster 21 is positioned with axial passage 27 aligned with the extrusion axis. In this position the end face 77 of the bolster provides a stationary bearing surface directly behind the pressure disc (not shown) in the cavity of the container. Turret 43 is indexed to place piercing stem 57 on the extrusion axis. Ram 31 is then activated for pushing piercing stem 57 through the loaded container. Stem 57 first passes through the die hole and pierces the billet, pushing out a plug at the other end of the billet. The plug passes through the central opening of the pressure disc and is ejected into axial passage 27, which because of its downward inclination, discharges the plug to an appropriately situated container therebeneath. The end face 77 of bolster 21 bears against the pressure plate, preventing the extrusion package from being pushed out of the container cavity. Thereafter the ram is retracted, withdrawing the piercing stem completely from the container. The bolster is shifted transversely to place axial passage 25 in alignment with the extrusion axis. It is significant that the end face 77 of bolster 21 remains in contact with the pressure disc when shifting from axial passage 27 which is utilized for piercing to axial passage 25 which is utilized during the extrusion cycle. Such continuous contact eliminates the possibility of the pressure disc falling out the back end of the container when switching from the piercing configuration to the extrusion configuration.

With the shift of bolster 21 to place axial passage 25 in alignment with the extrusion axis, turret 43 is also rotated to place pressing stem 55 on the extrusion axis. Ram 31 is again activated, causing pressing stem 55 to be extended for pushing the die (not shown) through the container, over an extrusion mandrel (not shown), causing the billet to be extruded through an annular space between the extrusion mandrel and die, sending a tubular extrusion product through the hollow pressing stem 55 and the exit passage through the ram constituted by conduits 69 and 71. The ram is then again retracted, the press turret is indexed, bringing a newly loaded container into the extrusion axis, and the piercing and extrusion cycles described above are repeated.

Figure 7:
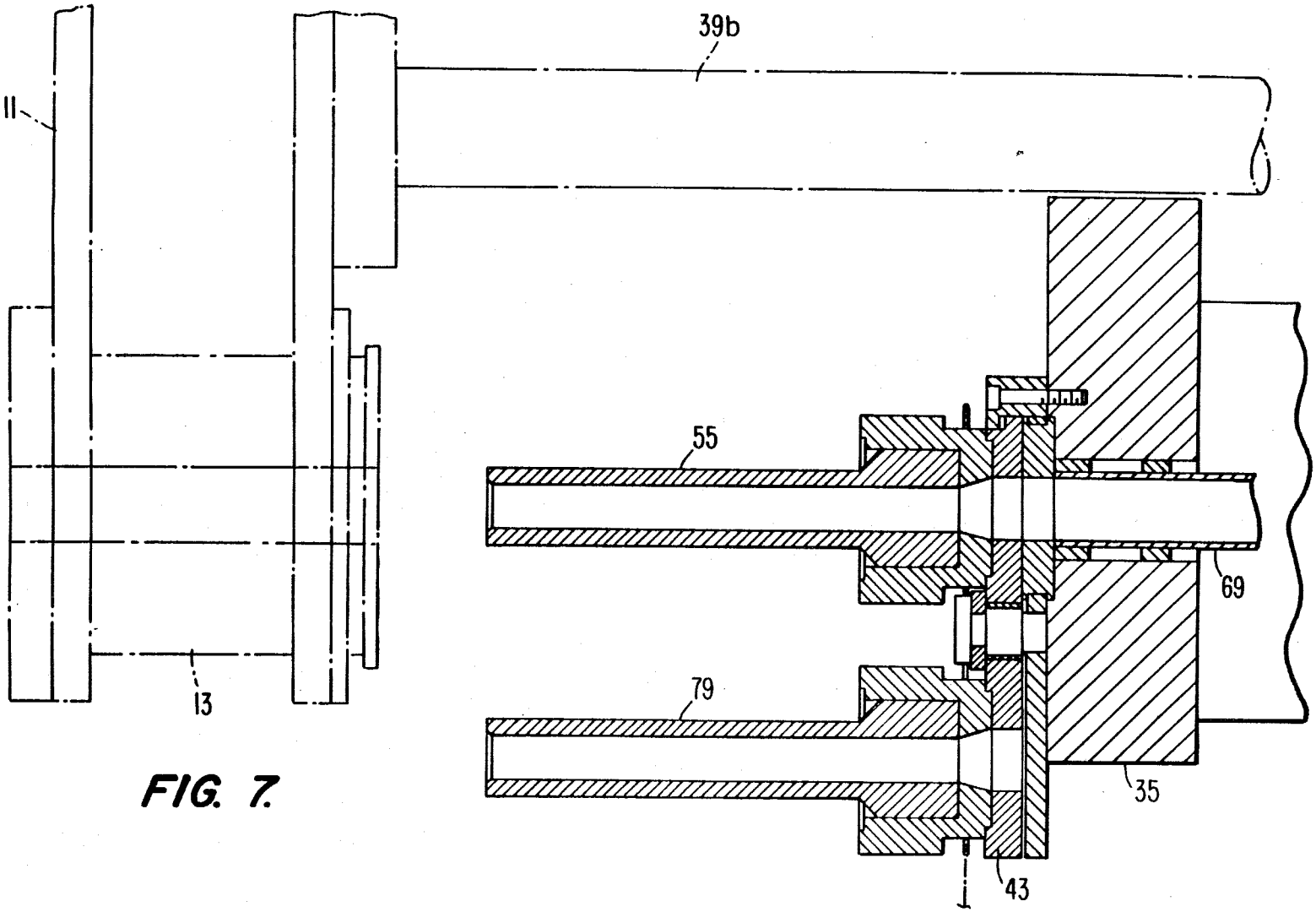
FIG. 7 is a cross sectional view of a ram-mounted turret supporting two pressing stems according to another embodiment of the invention.

According to another embodiment of the invention, where the billets are either prepierced outside of the press container, or are pierced within the press container by a piercing stem entering the container through the bolster, the piercing stem 57 is eliminated and another pressing stem may be mounted in its place. Such a configuration is shown in FIG. 7 wherein a second pressing stem 79 having a greater diameter than pressing stem 55 is mounted on turret 43. Accordingly, if it were desirable to change the containers of press turret 11 to put in containers having, for example, a cavity with a greater diameter than the existing containers in the press turret, in order to extrude billets of a correspondingly greater diameter, the arrangement according to FIG. 7 could be utilized to quickly change the pressing stem by rotating turret 43 to place pressing stem 79 on the extrusion axis. If sometime later the containers of the press turret 11 were changed again to the smaller diameter cavity, the turret 43 would then be rotated to place pressing stem 55 on the extrusion axis.

It will be understood that the above description of the present invention is susceptible to various modifications, changes and adaptations, and the same are intended to be comprehended within the meaning and range of equivalents of the appended claims.

What is claimed is:

1. An arrangement for an indirect extrusion press having an extrusion axis, comprising:

a container with first and second opposite axial ends and an axial cavity for receiving a billet, said container being mounted for aligning said axial cavity with the extrusion axis;

bolster means disposed adjacent said first axial end for blocking movement of a billet out of the cavity when a force is applied against the billet from said second axial end;

a ram mounted on the side of said container adjacent said second axial end for movement in the axial direction of said container, said ram having an axial passage therethrough aligned with said extrusion axis;

a rotatable turret mounted on said ram; and a hollow pressing stem mounted on said turret, said turret being rotatable for placing said hollow pressing stem in a first position aligned with said extrusion axis and in a second position off of said extrusion axis, wherein when said hollow pressing stem is in said first position its interior communicates with the passage through said ram and said hollow pressing stem can be moved axially, via said ram, to press a die through said cavity to extrude a billet disposed therein through such die to form an extrusion product which exits the container via said hollow pressing stem and the passage through said ram, and when said hollow pressing stem is in said second position it permits other tooling to perform operations on the extrusion axis.

2. An arrangement according to claim 1, wherein said bolster means includes an axial passage and is movable transversely of the extrusion axis for selectively placing said axial passage in a position on the extrusion axis for receiving an axially movable extrusion mandrel and in a position off of the extrusion axis.

3. An arrangement according to claim 1, and further comprising a piercing mandrel mounted on said turret and spaced apart from said hollow pressing stem, said turret being rotatable for selectively placing one of said piercing mandrel and said hollow pressing stem in said first position, and the other of said piercing mandrel and said hollow piercing stem in said second position wherein when said piercing mandrel is in said first position in can be moved axially, via said ram, for piercing a billet disposed in said container.

4. An arrangement according to claim 3, wherein said bolster means includes an axial passage and is movable transversely of the extrusion axis for selectively placing said axial passage in a position on the extrusion axis for receiving an axially movable extrusion mandrel and in a position off of the extrusion axis.

5. An arrangement according to claim 4, wherein said bolster means includes a second axial passage and is movable transversely of the extrusion axis for selectively placing said second axial passage in a position on the extrusion axis for receiving a plug produced when said piercing mandrel pierces a billet and in a position off of the extrusion axis.

6. An arrangement according to claim 5, wherein said bolster means has a radial opening communicating with said second axial passage, wherein a plug received by said second axial passage can be discharged from said bolster via said radial opening.

7. An arrangement according to claim 1, wherein said hollow pressing stem has a first outer diameter and further comprising a second hollow pressing stem mounted on said turret and having a second outer diameter, said turret being rotatable for placing a selected one of said hollow pressing stem and said second hollow pressing stem at said first position depending on whether said cavity has a diametrical dimension corresponding to said first or said second outer diameter.

8. An arrangement according to claim 7, wherein said first outer diameter is different than said second outer diameter.

9. A method for piercing and extruding a metal billet employing an indirect extrusion press having an extrusion axis, a press container with an axial cavity for receiving a billet and being mounted for aligning the cavity with the extrusion axis, bolster means disposed at one end of the cavity for blocking movement of the billet when a force is applied to the billet from the other end of the cavity, a ram axially movable with respect to the container and having a passage therethrough aligned with the extrusion axis, a rotatable turret mounted on the ram, a first hollow pressing stem mounted on the turret, the turret being selectively rotatable for placing the hollow press stem in a position on the extrusion axis in communication with the passage in the ram, and in another position off of the extrusion axis, said method comprising:

rotating the turret to place the pressing stem on the extrusion axis;

moving the ram toward the container to push a die through the container, extruding a billet disposed through such die to form an extrusion product which exits the container through the hollow stem and the passage through the ram.

10. The method according to claim 9, wherein the bolster means has an axial passage and is movable transversely of the extrusion axis for selectively placing the axial passage in a position on the extrusion axis for receiving an axially movable extrusion mandrel and in a position off of the extrusion axis, said method further comprising:

moving the bolster means to place the axial passage on the extrusion axis so that an extrusion mandrel can be inserted through the bolster and into a billet prior to moving the ram to extrude the billet.

11. A method according to claim 9, wherein the press includes a piercing mandrel mounted on the turret, the turret being additionally rotatable for selectively placing the piercing mandrel in a position on the extrusion axis and in another position off of the extrusion axis, said method further comprising:

rotating the turret, prior to extruding a billet, to place the piercing mandrel on the extrusion axis; and moving the ram toward the container allowing the piercing mandrel to pierce a billet in the cavity of the container; and retracting the ram to withdraw the piercing mandrel from such billet in preparation of said rotating step to place the pressing stem on the extrusion axis.

12. The method according to claim 11, wherein the bolster means has an axial passage and is movable transversely of the extrusion axis for selectively placing the axial passage in a position on the extrusion axis for receiving an axially movable extrusion mandrel and in a position off of the extrusion axis, said method further comprising:

moving the bolster means to place the axial passage on the extrusion axis so that an extrusion mandrel can be inserted through the bolster and into a billet prior to moving the ram to extrude the billet.

13. The method according to claim 12, wherein the bolster means includes a further axial passage and is movable transversely of the extrusion axis for selectively placing the second axial passage in a position on the extrusion and in a position off of the extrusion axis, said method further comprising:

moving the bolster means to place the second axial passage on the extrusion axis for receiving plug produced when the piercing mandrel pierces a billet

14. The method according to claim 9, wherein the press includes a second hollow pressing stem mounted on the turret and having a second outer diameter, and said rotating step includes rotating the turret for placing a selected one of the hollow pressing stems on the extrusion axis.

15. The method according to claim 14, wherein said second outer diameter is different from said first outer diameter and said rotating step includes rotating the turret for placing a selected one of the hollow pressing stems on the extrusion axis depending on whether the cavity of the container has a diametrical dimension corresponding to the outer diameter of the first or second hollow pressing stem, respectively.

* * * * *